US006550292B1

(12) United States Patent
Southworth et al.

(10) Patent No.: US 6,550,292 B1
(45) Date of Patent: Apr. 22, 2003

(54) DYNAMIC BALANCER FOR AN AUTOMATIC WASHER

(75) Inventors: Daniel W. Southworth, South Bend, IN (US); Eric K. Farrington, Stevensville, MI (US); Gregory M. Garstecki, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/541,310

(22) Filed: Apr. 3, 2000

(51) Int. Cl.[7] ..... D06F 37/24
(52) U.S. Cl. ..... 68/23.2; 68/23.5; 74/573 F
(58) Field of Search ..... 68/23.1, 23.2, 68/23.4, 23.5; 74/573 F; 210/144

(56) References Cited

U.S. PATENT DOCUMENTS

| | | | | | |
|---|---|---|---|---|---|
| 2,984,094 | A | * | 5/1961 | Belaieff | 68/23.2 |
| 3,494,471 | A | * | 2/1970 | Grippo | 68/23.3 |
| 4,044,626 | A | * | 8/1977 | Hayashi et al. | 68/23.2 |
| 5,345,792 | A | | 9/1994 | Farrington et al. | 68/23.2 |
| 5,460,017 | A | * | 10/1995 | Taylor | 68/23.2 |
| 5,490,436 | A | | 2/1996 | Coyne et al. | 74/573 F |
| 5,593,281 | A | | 1/1997 | Tai | 416/145 |
| 5,613,408 | A | | 3/1997 | Taylor et al. | 74/573 R |
| 5,709,109 | A | * | 1/1998 | Cho | 68/23.2 |
| 5,724,862 | A | | 3/1998 | Hannah et al. | 74/573 R |
| 5,746,069 | A | | 5/1998 | Kim | 68/23.2 |
| 5,761,932 | A | * | 6/1998 | Kim | 75/573 F |
| 5,782,110 | A | | 7/1998 | Kim | 68/23.2 |
| 5,802,885 | A | | 9/1998 | Kim | 68/23.2 |
| 5,806,349 | A | * | 9/1998 | Kim et al. | 74/573 F |
| 5,813,346 | A | | 9/1998 | Solomon | 101/483 |
| 5,829,318 | A | * | 11/1998 | Hanna et al. | 74/573 F |
| 5,855,127 | A | * | 1/1999 | Kohara et al. | 68/23.2 |
| 5,857,360 | A | * | 1/1999 | Kim et al. | 68/23.2 |
| 5,916,274 | A | * | 6/1999 | Lee et al. | 68/23.2 |
| 5,941,133 | A | * | 8/1999 | Wierzba et al. | 74/573 F |
| 6,119,547 | A | * | 9/2000 | Goransso et al. | 74/573 F |

FOREIGN PATENT DOCUMENTS

| | | | | |
|---|---|---|---|---|
| CA | 492238 | * | 4/1953 | 68/23.2 |
| EP | 924330 | | 12/1998 | D06F/37/22 |
| JP | 60-22215 | * | 5/1985 | 68/23.2 |
| JP | 62-16678 | * | 4/1987 | 68/23.2 |
| JP | 4-122387 | * | 4/1992 | 68/23.2 |
| JP | 4-187192 | * | 7/1992 | 68/23.1 |
| WO | WO 99/10583 | | 3/1999 | |

* cited by examiner

*Primary Examiner*—Frankie L. Stinson
(74) *Attorney, Agent, or Firm*—Thomas J. Roth; Robert O. Rice; John F. Colligan

(57) ABSTRACT

A dynamic balancer for an automatic washer includes an annular hollow first chamber. A first fluid is held within the first chamber and only partly fills the first chamber. An annular hollow second chamber is disposed adjacent to the first chamber and includes a plurality of objects disposed therein which are movable along the chamber. A second fluid is also held in the second chamber and, in combination with the solid bodies, only partly fills the second chamber. The first fluid in the first chamber produces a first balancing characteristic of the dynamic balancer. The movable objects within the second chamber produce a second balancing characteristic of the, dynamic balancer. The second fluid held in the second chamber also produces a third balancing characteristic of the dynamic balancer.

4 Claims, 2 Drawing Sheets

DYNAMIC BALANCER FOR AN AUTOMATIC WASHER

BACKGROUND OF THE INVENTION

The present invention relates generally to washing machines, and more particularly, to a combination dynamic balancer for a wash basket of a vertical axis washing machine.

It is common to spin a wash basket of a washing machine at high speed to extract washing fluid from the laundered articles within the basket. Invariably, the wet articles within the basket are not evenly distributed and create an unbalanced condition during the high speed spinning cycles of the machine. The unbalanced condition creates a rotating wash basket mass that does not correspond to the rotational axis of the wash basket and the washing machine. This generates unwanted stress on the components of the machine, excessive noise, severe vibration of the wash basket, and often movement of the machine. The loads created by the out of balance condition as well as the severe vibration can also create excessive wear and damage to the components of the washing machine.

It is therefore imperative that the wash basket including the wet articles therein be balanced to avoid these unwanted results. However, this is difficult because the out of balance condition varies from load to load and from machine to machine depending on the size of the machine, the quantity and weight of the articles being laundered and the variable positioning of the articles within the basket from load to load. The out of balance condition also varies for each load as the amount of water extracted from the articles within the basket changes during the period of each spin cycle. Therefore, it is imperative that any balancing mechanisms utilized in conjunction with the washing machine to correct these out of balance conditions be dynamic in nature.

One type of commonly used balancing device is known as a liquid balancing ring attached to the top of the basket. A typical liquid balancer ring includes an annular chamber that is partly filled, typically just over half full, with a fluid. This relatively simple balancer ring permits the fluid within the annular chamber to collect unevenly within the ring to offset an unbalanced condition of the wash basket U.S. Pat. No. 5,345,792 discloses multiple liquid balancing rings.

Another type of balancer is known as a ball balancer and is typically utilized on horizontal axis washing machines. A ball balancer has a hollow annular chamber in a balancing ring wherein a plurality of steel balls are held within the chamber. These balls roll through a viscous fluid also held within the chamber. The annular chamber is completely filled with fluid once the steel balls are placed in the chamber. The rolling balls can distribute unevenly within the chamber to offset an unbalanced condition in the wash basket. The viscous fluid tempers movement of the balls within the chamber. U.S. Pat. Nos. 5,593,281 and 5,802,885 discloses a ball balancing ring.

Another type of balancing device utilized on horizontal axis automatic washing machines is a combination ball and liquid balancer. This type of device includes an annular ring that is divided into two hollow annular chambers that are essentially concentric or stacked upon one another. One of the chambers houses a ball balancer as described above and the other chamber houses a liquid balancer also as described above. This type of device functions wherein the balls can shift to a position opposite the unbalance condition or heavy side of the wash basket for small unbalances. If the balancing balls are completely shifted and the wash basket still spins with some vibration, the liquid balancing portion of the combined device further reduces the unbalance condition by shifting liquid to collect opposite the out of balance condition or heavy side of the wash basket. This combination ball and liquid balancer therefore simply extends the range of unbalance that a normal ball balancing device could handle. The combined liquid and ball balancer described above also provides somewhat of an improvement for wash basket stability during start up and also when a wash basket is spinning at high speeds and is empty. One example of a combination balancer is disclosed in WO99/10583.

The above balancing devices have their limitations. They can only cover limited ranges of out of balance conditions for vertical axis washing machines. Additionally, the ball balancer has typically not been used on vertical axis washing machines.

SUMMARY OF THE INVENTION

One object of the present invention is to provide a balancing device for a vertical axis washing machine. Another object of the present invention is to provide a balancing device for automatic washing machines that provides an increased range of unbalance coverage over prior balancing devices. A further object of the present invention is to provide a balancing device that produces such increased range without increasing the cost of the balancing device. A still further object of the present invention is to provide a balancing device for automatic washing machines that has three separate balancing elements or characteristics producing a triple balancing device.

To achieve these and other objects, features and advantages of the present invention, a balancing device in one embodiment is constructed as an annular ring divided into two separate hollow annular chambers. A first chamber has a first fluid held therein that only partly fills the first chamber. The second chamber is disposed adjacent the first chamber and has a plurality of objects held therein that are movable within the second chamber. A second fluid is also held in the second chamber and, in combination with the objects, only partly fills the second chamber.

In one embodiment, the first fluid is water. In another embodiment, the first fluid is salt water. In one embodiment, the first fluid fills about one-half of the first chamber.

In one embodiment, the second chamber is stacked on top of the first chamber and is co-axial therewith. In another embodiment, the first chamber is at least partly defined in a first annular material ring and the second chamber is at least partly defined in a second annular material ring. In one embodiment, the second annular ring is stacked on top of the first annular ring and is attached thereto. In one embodiment, a third annular ring is disposed between the first and second annular ring and separates the first and second chambers.

In one embodiment, the dynamic balancer device includes a third injection molded ring of material defining a race. The race is attached to a second upper injection molded annular ring defining an inverted annular channel wherein the second chamber is defined between the race and the upper ring. A first lower injection molded ring of material that defines an annular channel is attached to the combined race and upper ring and defines the first chamber between the lower ring and the race. In one embodiment, each of these injection molded compartments is adhered to one another by heat welding, sonic welding, spin welding, or hot plate welding.

In one embodiment, the upper ring includes a pair of opposed depending walls and the race includes a pair of opposed edges that are attached to the depending walls of the upper ring. The lower ring includes a pair of upstanding and opposed walls. The lower ring is connected to the combined upper ring and race so that the attachment joints between the race and upper ring are received in the first chamber between the upstanding walls of the lower ring.

In one embodiment, the plurality of objects are each capable of rolling within the second chamber. In one embodiment, the objects are spherical balls. In another embodiment, the balls are steel balls.

In one embodiment, the second fluid has a higher viscosity than the first fluid. In one embodiment, the second fluid is an oil. In one embodiment, the oil is a ten weight oil. In one embodiment, the second fluid and the solid bodies, in combination, fill about one-half of the second chamber.

In another embodiment of the invention, an automatic washer includes an imperforate tub and a perforate wash basket disposed within the tub. The wash basket is rotatable about a generally vertical axis and has an annular top edge defining an opening. A rotary dynamic balancer is associated with the top edge of the wash basket and includes an annular hollow first chamber. A first fluid is held in the first chamber and only partly fills the chamber. An annular hollow second chamber is disposed adjacent to the first chamber and includes a plurality of solid bodies disposed therein. The solid bodies are movable within the second chamber. A second fluid is held within the second chamber and, in combination with the solid bodies, only partly fills the second chamber.

These and other objects, features and advantages of the present invention will become apparent upon reviewing the written description and the accompanying drawings. The foregoing and other objects of the invention are attained by a dynamic balancer that provides three separate balancing functions. The first function is provided by the first fluid held within the first chamber. The fluid itself will collect within the first chamber opposite an out of balance or heavy side of a rotating object. The second balancing function is provided by the objects held within the second chamber. The objects will roll or slide within the second chamber and collect opposite an out of balance or heavy side of a rotating object. The third balancing function is provided by the viscous fluid within the second chamber since it does not fill the remaining volume of the second chamber. The viscous or second fluid will also flow and collect within the second chamber opposite an out of balance or heavy side of a rotating object.

DETAILED DESCRIPTION OF THE PREFERRED EMBODIMENTS

Figure 1:
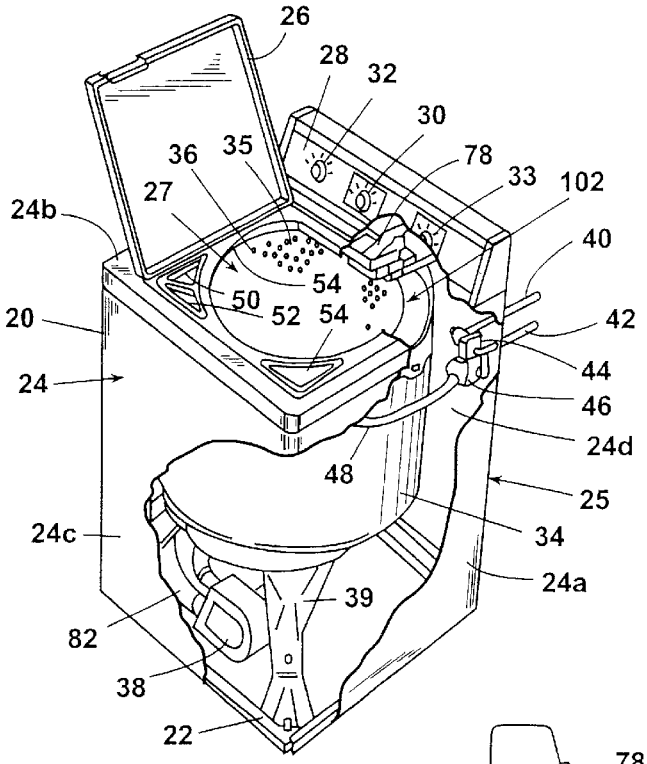
FIG. 1 is a general perspective view of an automatic washer partially cut away to illustrate various interior components.
Figure 2:
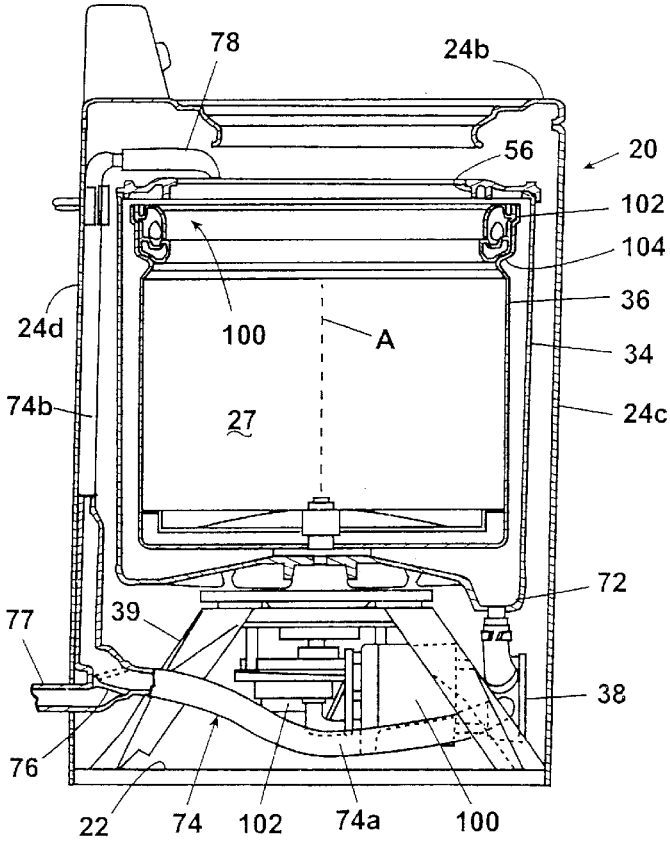
FIG. 2 is a side sectional view of the automatic washer of FIG. 1.

Referring now to the drawings, FIGS. 1 and 2 illustrate an automatic washer construction for which the balancing device of the invention is useful. The automatic washer 20 generally refers to a washing machine having a pre-settable control for operating a washer through a pre-selected wash cycle program including automatic washing, rinsing and drying operations. During at least the drying operation, the washing machine 20 operates at relatively high rotational speeds in order to extract water from articles such as clothing that have been washed by the machine. This portion of a wash cycle is commonly known as the spin cycle.

The washing machine 20 includes a frame 22 carrying vertical panels 24, forming sides 24*a*, a top 24*b*, a front 24*c*, and a back 24*d* of a cabinet 25. A hinged lid 26 is provided in the usual manner for access to the interior or treatment zone 27 of the washing machine 20. The washer 20 also includes a console 28 having a timer dial 30 or other timing mechanism and a temperature selector 32 as well as a cycle selector 33 and other selectors as desired.

Internally, the exemplary washing machine also includes an imperforate tub 34 within which a wash basket 36 is received. The wash basket 36 is perforated including a number of holes 35 permitting fluid to pass between the wash basket interior and the tub. A pump 38 is provided below the tub 34. The wash basket 36 defines an open top wash chamber and has an upstanding sidewall 37. Baffles may be provided on the interior of the sidewall 37 or on an upstanding axial projection for agitating the water and articles within the wash basket during a wash cycle as is commonly known. A motor 100 is operatively connected to the wash basket 36 through a transmission 102 to rotate the wash basket 36 relative to the stationary tub 34. All of the components within the cabinet 25 are supported by struts 39.

Water is supplied to the imperforate tub 34 by hot and cold water supply inlets 40 and 42. A hot water valve 44 and a cold water valve 46 are connected to a manifold conduit 48. The manifold conduit 48 is interconnected to a plurality of wash additive dispensers 50, 52 and 54 disposed around a top opening 56 above the tub 34, just below the lid 26. As shown in FIG. 1, the dispensers are accessible when the hinged lid 26 is opened. Dispensers 50 and 52 can be used for dispensing additives such as bleach or fabric softeners and dispenser 54 can be used to dispense detergent, either liquid or granular, into the wash load at an appropriate time during the automatic wash cycle. Each of the dispensers 50, 52 and 54 is typically supplied with liquid, generally fresh water, through separate dedicated conduits (not shown). Each of the conduits can be connected to a fluid source in a conventional manner, such as through respective solenoid operated valves (also not shown), which contain built-in flow devices to control flow rate, connecting each conduit to the manifold conduit 48.

Disposed at the bottom of the tub 34 is a sump portion 72 for receiving wash liquid supplied into the tub through the wash additive dispensers 50, 52 and 54. A pressure sensor (not shown) is disposed in the sump 72 for controlling the quantity of wash liquid added to the wash tub 34. The pump 38 is fluidly interconnected with the sump 72 and is operable for drawing wash liquid from the sump 72 and moving the liquid through a recirculation line 74 having a first portion 74*a* and a second portion 74*b*. A two-way drain valve 76 is provided in the recirculation line 74 for alternately directing wash liquid flow to a drain line 77 or to the second portion 74*b* of the recirculation line 74.

A nozzle 78 is fluidly connected with a recirculation line 74. The nozzle 78 extends beyond the top opening 56 of the tub 34 and is positioned above the wash basket 36 such that wash liquid flowing through the recirculation line 74 is sprayed into the basket 36 and on to clothes disposed in the basket below the nozzle 78. Wash liquid can therefore be recirculated over clothing disposed in the wash basket 36.

The above described general description of a washing machine 20 is provided for illustration only. As will be evident to those skilled in the art, the general construction of the machine 20 can vary considerably without departing from the spirit and scope of the present invention. The present invention is directed to a balancing device for the washing machine 20 as is described below.

The cross section of FIG. 2 generally illustrates a balancer device 100 carried at a top edge 102 of the wash basket 36. The top opening 56 of the wash tub 34 is disposed adjacent the top edge 102 of the wash basket 36 providing access directly into the wash basket.

Figure 3:
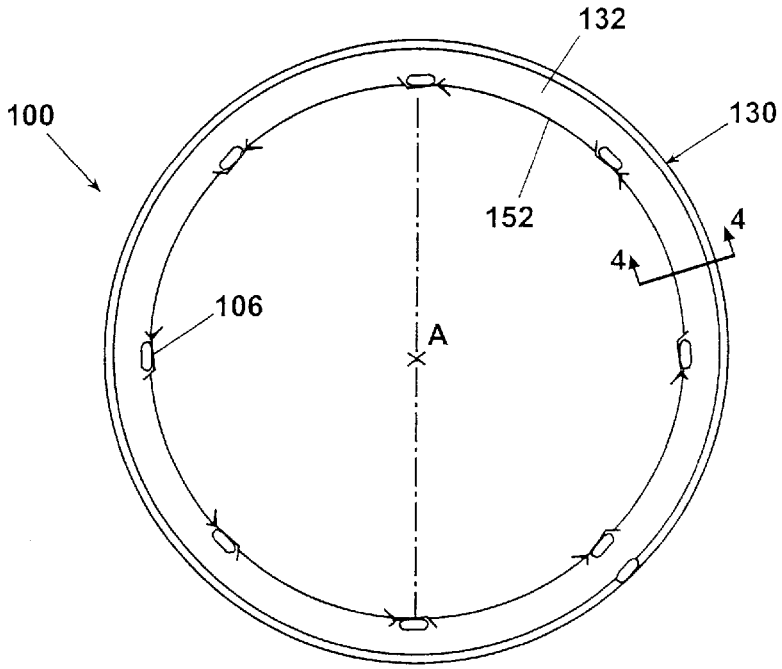
FIG. 3 is a top view of a balancing device constructed in accordance with one embodiment of the present invention.

The dynamic balancer 100 is received within the opening of the top edge 102 of the wash basket 36. The contour of the top edge 102 of the wash basket 36 is conformed to receive the balancer device 100 therein and to provide a ledge or step 104 on which the device 100 can rest. FIG. 3 illustrates a top view of the balancer device 100 illustrating that the device is an annular ring to be received within the top edge 102 of the basket 36. The balancer 100 can include a plurality of clips 106 for securely holding the balancer to the wash basket 36.

Figure 4:
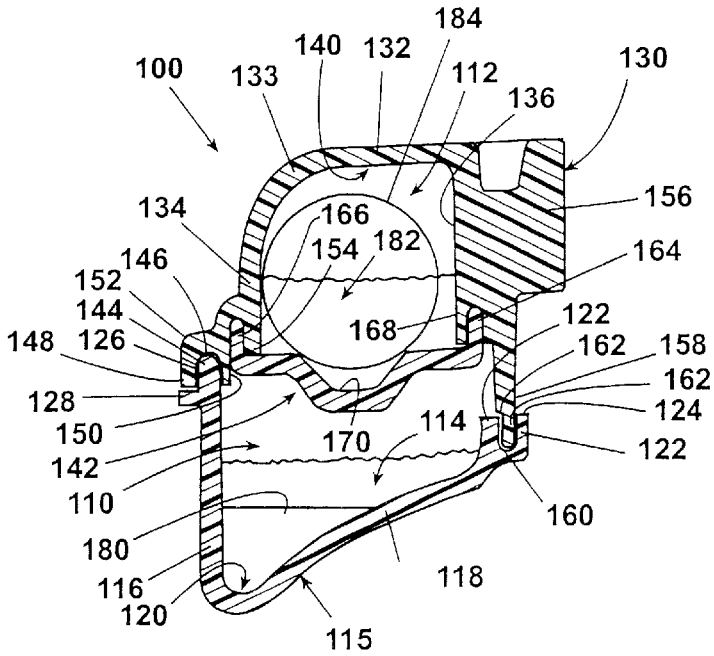
FIG. 4 is a cross section taken along line IV—IV of FIG. 3 and illustrating the internal components and construction of the balancer of FIG. 3.

FIG. 4 illustrates a cross section of the annular ring balancer device 100 in one embodiment. The device 100 includes generally a lower continuous annular chamber 110 and an upper continuous annular chamber 112. In the preferred embodiment, the chambers 110 and 112 are arranged coaxially and stacked on top of one another at essentially the same radius relative to a center longitudinal axis A of the wash basket 36. However, the chambers could be arranged on the basket differently, either at different radii and/or spaced apart vertically or horizontally, and not adjacent to one another as shown in the illustrated preferred embodiment, all departing from the invention disclosed herein.

In the present embodiment, the lower or first chamber 110 has a cross sectional area which when extended around the entire circumference of the chamber defines a first chamber volume. A first fluid 114 having a first fluid volume that is less than the volume of the chamber 110 partly fills the chamber. In the present embodiment, the first fluid 114 is water and is preferably salt water. The first fluid 114 and chamber 110 define a fluid type balancer.

The lower or first chamber 110 is defined by a first annular ring of material 115 having an inner annular wall 116 disposed generally parallel relative to the vertical axis A connected at a bottom end to a bottom wall 118. The bottom wall is upwardly tapered relative to the inner wall 116 moving outward from the center or vertical axis A of the device 100. Together, the inner wall 116 and bottom wall 118 define a trough or channel 120 therein.

The outer edge of the bottom wall 118 includes a pair of spaced apart and upwardly extending annular flanges 122 defining a groove 124 therebetween. The upper end of the inner wall 116 defines an annular tongue 126 extending upward therefrom. An inwardly directed flange 128 extends from the wall 116 just below the tongue 126. Each of the walls, grooves and flanges extends around the circumference of the device 100.

An upper annular material ring 130 of the balancer device 100 interconnects with the lower annular ring 115. The upper ring 130 includes a top wall 132 that transitions via a curved section 133 into a downwardly depending annular inner wall 134. The outer edge of the top wall 132 further from the axis A also includes a downwardly extending outer wall 136 spaced radially outwardly from the inner wall 134. The combination of the outer wall 136, top wall 132 and inner wall 134 define an inverted annular channel 140 therebetween.

The inverted annular channel 140 and the trough or channel 120 are divided or separated by an annular third ring of material 142. The third annular ring 142 is disposed generally horizontal between the inner and outer walls of the upper and lower material rings 115 and 130, respectively. The annular ring 142 therefore generally separates the balancer device 100 into the two chambers 111 and 112. The particular construction of the three annular material rings 115, 130 and 142 of the device in the present embodiment of the invention provides additional benefits described in greater detail below.

The inner wall 134 of the upper material ring 130 defines a pair of adjacent annular grooves 144 and 146 extending upward. The first groove 144 is disposed radially inward from the second groove 146 relative to the axis A of the balancer device 100. The second groove 146 is disposed closer to the chamber 112 as a result. The first groove 144 is defined between a pair of depending annular flanges 148 and 150 which depend downward from a step 152 extending radially inward from the inner wall 134 of the upper material ring 130. The second groove 146 is formed between the annular flange 150 and a distal end 154 of the inner wall 134 and is therefore disposed between the step 152 and the radial inner wall 134.

The rear wall 136 of the material ring 130 includes a thick section 156 extending radially outward therefrom. An annular leg 158 depends from the thickened section 156 and terminates at an annular tongue 160. The tongue 160 has a lesser thickness than the leg 158 and therefore defines a pair of shoulders or steps 162 between the tongue and the leg. A groove 164 is also formed between the outer wall 136 and the leg 158 of the thickened section 156.

The horizontally disposed annular ring 142 includes an inner radial edge having a tongue 166 projecting upward therefrom and an outer radial edge having a tongue 168 projecting upward therefrom. The material ring 142 also includes a recessed channel or race 170 formed therein. The purpose of the race 170 is described in greater detail below. Again, each of the grooves, flanges, tongues, channel and walls is annular in construction extending around the circumference of the device.

The balancer device 100 is assembled by generally connecting the three annular material rings 115, 130 and 142 to one another. The material ring 142 is placed below and adjacent the material ring 130 so that the tongue 166 aligns with the groove 146 and the tongue 168 aligns with the groove 164. The tongues are received in the grooves and the materials adhere to one another by a suitable welding process in a manner described in greater detail below. The lower material ring 115 is then placed adjacent the assembled upper ring 130 and horizontally disposed third ring 142. The tongue 160 of the leg 158 is received in the groove 124 of the bottom wall 118 of the lower ring 115. The tongue 126 of the inner radial wall 116 of the ring 115 is received in the groove 144 of the step 152 of the upper material ring 130. The tongues and grooves of these two components are again adhered to one another by a suitable welding process described in more detail below.

Upon assembly, the chamber 110 is defined by the inner wall 116 and bottom wall 118 of the lower or first ring 115 as well as the bottom surface of the interior horizontal ring 142 and the depending leg 158 of the upper or second ring 130. The upper chamber 112 is defined by the top wall 132, inner wall 134 and outer wall 136 of the upper ring 130 as well as the top surface of the interior or third ring 142.

Each of the annular rings 115, 130 and 142 is preferably made from an injection molded plastic material but could be made from virtually any suitable material including plastics, composites, metals, alloys, or the like. In the present embodiment, the injection molded components are welded to one another at the joints created by the tongues and grooves described above. The welding process can be a hot plate or heat welding process, a spin welding process, a sonic welding process or the like. The welding process must at least create a sealed material joint between each assembled tongue and groove of the device 100 so that the joints don't leak. Adhesives may alternatively be used to adhere the components to one another. If the materials selected are not suitable for plastic welding processes, the components must simply be adhered relative to one another in order to create a fluid tight seal at each joint.

As noted above, a first fluid 114 such as water or salt water is disposed within the lower or first chamber 110. The first fluid 114 partly fills the chamber and is free to flow around the annular chamber. A plurality of baffles 180 can be formed in the trough or channel 120 of the lower or first ring 115 wherein the baffles extend upward generally perpendicular to the bottom wall 118. The plurality of baffles 180 serve to stabilize the flow of fluid within the chamber 110 and yet permit the fluid 114 to flow within the chamber as necessary to perform the intended balancing function of the balancer device 100.

A second fluid 182 is disposed within the second chamber 112 and preferably has a higher viscosity than the first fluid 114. In one embodiment, the second fluid 182 is an oil. In another preferred embodiment, the oil is a 10 weight (10 W) oil. Also disposed within the upper chamber 112 are a plurality of weighted spherical balls 184. In one embodiment, the balls 184 are comprised of steel. The composition of the second fluid 182 and the material composition and construction of the balls 184 can vary considerably within the scope of the present invention. In addition, the balls 184 can be replaced by a plurality of other objects that add mass to the balancer device 100. For example, the balls 184 can be replaced by disks, cylinders, or other such weighted sliding or rolling elements that are free to travel along the circumference of the chamber 112. In the present embodiment, the race 170 of the interior material ring 142 is provided for precisely guiding the balls 184 along the chamber 112 at a particular radius from the center axis A of the device. The second fluid, balls and second chamber generally define a ball balancer.

The second fluid 182 composition can be virtually any fluid providing a desired viscosity that will not damage the balls, the material of the annular rings 142 and 130, or the construction of the joints securing the two components together. The type of fluid such as the oil noted above can vary considerably within the scope of the present invention as will be evident to those skilled in the art. The volume of the second fluid 182 is less than the remaining volume of the second chamber 112 after adding the balls 184.

In use, the balancer device 100 produces three separate balancing elements or characteristics. One balancing element or characteristic produced by the balancer device 100 of the invention is provided by the plurality of sliding or rolling elements or steel balls 184. The balls will roll within the chamber 112 and collect at a higher concentration or density opposite a small out of balance or heavy condition within the wash basket 36. The balls 184 are inhibited from freely rolling within the chamber 112 by the second fluid 182. The higher viscosity of the second fluid controls movement of the balls 184. Therefore, for minor or small out of balance conditions of the wash basket 36, the balls 184 and second fluid 182 will provide an initial balance correction. If the ball movement within the second chamber 112 is sufficient to correct the out of balance, the balls will essentially distribute as needed throughout the chamber 112 and remain as positioned once the minor out of balance condition is corrected. If a larger out of balance condition occurs wherein the balls 180 cannot sufficiently correct the condition, the balls will remain positioned within the chamber 112 as collected with greater density opposite the out of balance condition, but will not completely balance the basket 36.

Another balancing characteristic is therefore provided by the first chamber 110 and the first fluid 114. As the wash basket 36 spins, the larger out of balance condition will cause the wash basket to waiver from the center axis A of rotation of the basket. The out of balance condition will cause the first fluid 114 within the chamber 110 to flow and distribute at a higher volume within one portion of the chamber. The fluid will also gather in greater volume opposite the out of balance condition or heavy condition of a wash load held within the basket 36. The first fluid 114, combined with the balls 184 often provide sufficient offset to correct the out of balance condition.

There are instances however where significant out of the balance conditions occur that cannot be corrected by the movement of the weighted steel balls 184 and the flow of the first fluid 114. With that in mind, the third characteristic or element of the balancer device 100 is provided by the quantity of the second fluid 182 within the chamber 112. By only partly filling the chamber 112 with the second fluid 182 after addition of the balls 184, the second fluid can also flow relatively freely within the upper or second chamber 112. If the first fluid 114 and the balls 184 cannot correct an out of balance condition, the second fluid 182 will therefore flow within the second chamber 112 and gather at a higher volume opposite the out of balance condition providing further balance correction for the device 100 of the invention.

In a preferred embodiment, the volume of the first fluid 114 is about one-half the volume of the first chamber 110. The volume of the second fluid 182 in a preferred embodiment is about one-half that of the remaining volume of the second chamber 112 after inclusion of the balls 184 or other weighted elements within the chamber. These volumes can vary within the scope of the present invention as well wherein the volumes noted above are provided merely as one preferred embodiment.

Similarly, the construction of the balancer device 100 including the three annular material rings 115, 130 and 142 can also vary considerably and yet fall within the scope of the present invention. In the described embodiment, the first chamber 110 is disposed directly below the second chamber 112. In one alternative embodiment, the second chamber 112 can be disposed below the first chamber 110. In another alternative embodiment, one of the chambers can be disposed radially inward or outward relative to the other of the chambers and relative to the center axis A of the device 100.

The particular construction of the attachment joints for each of the rings 115, 130 and 142 can also vary considerably and yet remain within the scope of the invention. However, the described embodiment provides a significant advantage over many other possible embodiments in that the second fluid 182 such as oil disposed within the second chamber 112 will not enter the wash basket 36 if a leak occurs at one of the joints that seal the second chamber. In a described embodiment, the tongue 168 and groove 164 forming one joint of the second chamber 112 is disposed radially inward of the annular leg 158 and therefore generally within the first chamber 110. Similarly, the tongue 166 and the groove 146 defining the other joint of the second chamber 112 is disposed radially outward from the inner wall 116 of the lower chamber 110 and therefore is also generally disposed within the first chamber. If a leak occurred at either joint of the second chamber 112, any oil or fluid 182 escaping from the second chamber would only escape into the first chamber 110 and not into the wash basket 36. Therefore, the risk of the second fluid 182 escaping into the wash basket is significantly reduced. The construction and orientation of the components defining the two chambers can vary from the described embodiment and yet still provide this leak preventing benefit.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A dynamic balancer device for an automatic washer including a rotatable wash basket for receiving a wash load, the balancer device comprising:

an annular hollow first chamber mounted to rotate with the basket;

a first fluid held in and only partly filling the first chamber;

an annular hollow second chamber mounted to rotate with the basket;

a plurality of objects disposed in the second chamber and movable therein; and a second fluid held in the second chamber and, in combination with the objects only partly filling the second chamber;

the first chamber being at least partly defined in a first annular ring of material and the second chamber being at least partly defined in a second annular ring of material, the first and second annular rings attached to one another;

a third annular ring of material disposed generally horizontally between the first and second annular rings separating the first and second chambers from one another, wherein the third annular ring is attached at a pair of joints to the second annular ring, and wherein the first annular ring is attached to the combined second and third annular rings with the pair of joints disposed within the first chamber.

2. A dynamic balancer device for an automatic washer including a rotatable wash basket for receiving a wash load, the balancer device comprising:

an annular hollow first chamber mounted to rotate with the basket;

a first fluid held in and only partly filling the first chamber; the first chamber being partly filled with only the first fluid;

an annular hollow second chamber mounted to rotate with the basket;

a plurality of objects disposed in the second chamber and movable therein; and a second fluid held in the second chamber and, in combination with the objects only partly filling the second chamber, wherein the second fluid has a higher viscosity than the first fluid.

3. A triple element dynamic balancer comprising:

an annular first ring of material at least partly defining a continuous annular first chamber;

a first fluid having a first viscosity held in and only partly filling the first chamber; the first chamber being partly filled with only the first fluid;

an annular second ring of material at least partly defining a continuous annular second chamber, the second ring connected to the first ring;

a plurality of generally spherical balls disposed in the second chamber and capable of rolling around the second chamber; and a second fluid held in the second chamber, the second fluid having a second viscosity that is higher that the first viscosity and, the second fluid, in combination with the balls, only partly filling the second chamber.

4. The dynamic balancer according to claim 3, further comprising:

a third annular ring of material disposed at least partly between the first and second annular rings and separating the first and second chambers from one another.

* * * * *